US005247947A

United States Patent [19]

Clearman et al.

[11] Patent Number: 5,247,947

[45] Date of Patent: Sep. 28, 1993

[54] CIGARETTE

[75] Inventors: Jack F. Clearman, Blakely, Ga.; Robert L. Meiring, Winston-Salem; Donald R. Wilkinson, Clemmons, both of N.C.

[73] Assignee: R. J. Reynolds Tobacco Company, Winston-Salem, N.C.

[21] Appl. No.: 723,350

[22] Filed: Jun. 28, 1991

Related U.S. Application Data

[63] Continuation-in-part of Ser. No. 642,233, Jan. 23, 1991, which is a continuation-in-part of Ser. No. 488,516, Feb. 27, 1990, Pat. No. 5,027,837.

[51] Int. Cl.[5] ..... A24B 15/00

[52] U.S. Cl. ..... 131/194; 131/359; 131/353; 131/369

[58] Field of Search ..... 131/370, 359, 369, 353, 131/194

[56] References Cited

U.S. PATENT DOCUMENTS

| | | | |
|---|---|---|---|
| 2,164,702 | 7/1939 | Davidson . | |
| 3,313,305 | 8/1965 | Noznick et al. . | |
| 3,477,440 | 11/1969 | Licis | 131/370 |
| 3,805,803 | 4/1974 | Hedge et al. | 131/353 |
| 4,903,714 | 2/1990 | Barnes et al. . | |
| 4,924,888 | 5/1990 | Perfetti et al. . | |
| 5,019,122 | 5/1991 | Clearman et al. . | |

FOREIGN PATENT DOCUMENTS 342538 12/1989 European Pat. Off. .

*Primary Examiner*—V. Millin
*Assistant Examiner*—J. Doyle
*Attorney, Agent, or Firm*—Grover M. Myers; David G. Conlin

[57] ABSTRACT

A cigarette including a longitudinally segmented combustible fuel element, and a substrate carrying tobacco extract and glycerin positioned physically separate from the fuel element is disclosed. The substrate is a gathered paper-type material, and is positioned in a spaced apart relationship from the fuel element. One preferred smoking article of the present invention is a cigarette which comprises (i) a symmetrical and longitudinally segmented combustible fuel element; (ii) a physically separate aerosol generating means including at least one aerosol forming material; and (iii) means for securing, maintaining or retaining the fuel element within the smoking article. The symmetrical fuel element of the present invention comprises two substantially identical end segments; a longitudinally disposed intermediate segment; and two, preferably identical, reduced cross-sectional area (or reduced circumference) segments (also called "isolation" segments) located between each of the end segments and the intermediate segment. The symmetrical nature of the fuel element allows it to be inserted into the cigarette without concern as to any particular longitudinal orientation. Thus, when placed in a cigarette, one end segment of the fuel element serves as a burning segment, while the other end segment serves as a base segment.

38 Claims, 4 Drawing Sheets

CIGARETTE

CROSS-REFERENCE TO RELATED APPLICATIONS

This is a continuation-in-part of U.S. patent application Ser. No. 07/642,233, filed Jan. 23, 1991, which in turn is a continuation-in-part of U.S. patent application Ser. No. 07/488,516, filed Feb. 27, 1990, issuing on Jul. 2, 1991 as U.S. Pat. No. 5,027,837. The disclosures of these applications are hereby incorporated herein by reference.

BACKGROUND OF THE INVENTION

The present invention relates to smoking articles such as cigarettes, and in particular, to those smoking articles having a heat source and a physically separate aerosol generating means. Such smoking articles include a combustible fuel element, which upon use, is capable of producing heat which is transferred to the aerosol generating means for resultant aerosol production. Such smoking articles are capable of providing the pleasures of smoking (e.g., smoking taste, feel, satisfaction, and the like), by heating, but not necessarily burning, tobacco in various forms. In addition, such smoking articles are capable of providing very low yields of mainstream carbon monoxide.

Cigarettes, cigars and pipes are popular smoking articles which use tobacco in various forms. Many smoking products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

Smoking articles which are capable of providing the pleasures associated with cigarette smoking, by heating but not necessarily burning tobacco, and without delivering considerable quantities of incomplete combustion products, are described in U.S. Pat. Nos. 4,714,082 to Banerjee et al.; 4,756,318 to Clearman et al.; 4,793,365 to Sensabaugh, Jr. et al.; 4,819,665 to Roberts et al.; 4,854,311 to Banerjee et al. and 4,881,556 to Clearman et al.; 4,991,596 to Lawrence et al.; and in European Patent Publication No. 342,538. Such smoking articles employ a combustible fuel element for heat generation, and aerosol forming substances positioned physically separate from, and in a heat exchange relationship with, the fuel element. During use, heat generated by the fuel element acts to volatilize the aerosol forming substances, thereby providing an aerosol. Such smoking articles provide for extremely low yields of visible sidestream smoke as well as low yields of FTC "tar".

It would be desirable to provide a cigarette including a fuel element and a physically separate aerosol generating means, which cigarette:

(i) is capable of providing substantial quantities of aerosol containing volatilized tobacco components, (ii) makes efficient use of heat generated by the fuel element for aerosol formation, (iii) is capable of providing very low yields of mainstream carbon monoxide, (iv) is relatively cool to the touch when held during use.

(v) is light in weight (i.e., is comparable to a Class A cigarette), (v) is easy and cost effective to manufacture, particularly at high speeds using cigarette making machinery, and These and other desirable attributes of smoking articles, and particularly cigarettes, are provided by the smoking articles of the present invention, which are described below.

SUMMARY OF THE INVENTION

The present invention relates to cigarettes and other smoking articles which include a fuel element (i.e., a heat source), a physically separate aerosol generating means, in which the composition and configuration of the fuel element, as well as the positioning of the fuel element within the smoking article, are such that very efficient use is made of the heat generated by that fuel element.

In preferred smoking articles of the present invention, a high proportion of the heat produced by a burning fuel element is transferred to the aerosol generating means for aerosol production. The smoking articles of the present invention also incorporate tobacco in some form, advantageously in a variety of forms.

One preferred smoking article of the present invention is a cigarette which comprises (i) a longitudinally segmented combustible fuel element; (ii) a physically separate aerosol generating means including at least one aerosol forming material; and (iii) means for securing, maintaining or retaining the fuel element within the smoking article.

The segmented fuel element of the present invention comprises two end segments; at least one longitudinally disposed intermediate segment; and at least two isolation segments separating the end segments from the intermediate segment(s). Preferably, the end segments of the fuel element are substantially the same (in composition, size and shape) so that either end may be used as the burning portion (or segment) of the fuel element. This similarity of design simplifies the manufacture of smoking articles employing such fuel elements, because the fuel element may be used without regard to longitudinal orientation.

More preferably, the segmented fuel element of the present invention is symmetrical in design. The symmetrical nature of the fuel element allows it to be inserted into the cigarette without concern as to any particular longitudinal orientation. Thus, when placed in a cigarette, one end segment of the fuel element serves as a burning segment, while the other end segment serves as a base segment.

The segmented nature of the fuel element is designed such that when employed in a smoking article, preferably only the burning end segment, typically a relatively small portion of the overall length of the fuel element burns during use. The other end segment serves as a base which does not burn, and which aids in securing the fuel element in place within the smoking article. As described above, one or more intermediate segments are disposed between the end segments. These intermediate segments serve as a heat sink area, i.e., an area which draws heat away from the isolation segment. Two or more isolation segments separate the end segments from the intermediate segment(s), and in the case of a plurality of intermediate or heat sink segments, separate the intermediate segments from each other.

The isolation segments of the fuel element serve.as areas of restricted thermal conductivity through the fuel element. The isolation segments have a reduced cross-sectional area, as compared to the end segments. Preferably, the isolation segments have a reduced cross-sectional area as compared to the intermediate segments. The isolation segments serve to reduce the rate of heat loss from the burning segment through the fuel element, particularly during smolder. This in turn reduces the amount of fuel consumed in the burning segment during smolder, and reduces the total amount of fuel necessary to be burned in the burning segment for overall generation of heat. Heat transfer from the burning segment to the other segments of the fuel element is minimized by the presence of the one or more isolation segments. This reduction in heat transfer through the fuel element also serves to minimize the amount of radiant heat that can be transferred from the mouthend surface of the fuel element to the other components of the smoking article, such as the aerosol generating means.

When the fuel elements of the present invention are employed in smoking articles, particularly such as those described herein (e.g., FIGS. 1-3), the presence of the isolation segments in the fuel element aids in self-extinguishing the fuel element. It has been found that fuel elements having a burning segment and an adjacent isolation segment, do not burn appreciably beyond the burning segment. While not wishing to be bound by theory, it is believed that once the combustion of the burning segment is complete, the isolation segment serves to extinguish the fuel, in part because its reduced size is inadequate to support continued combustion during smolder and due to the heat sink effect of the larger intermediate and base segments, each of which draws heat away from the smaller isolation segment, substantially cooling the same. The location of the isolation segment in the cigarette is also believed to contribute to the self-extinguishing nature thereof, due to oxygen deprivation caused by an air impervious overwrap employed over the isolation segment.

Thus, when employed in smoking articles, especially those described herein, the isolation segment, which is longitudinally adjacent the burning segment, serves as a point at which the fuel element self-extinguishes during smolder, once the burning segment has been consumed. The cigarettes of the present invention preferably self-extinguish at the isolation segment after the burning segment is consumed when the cigarette is smoked under FTC smoking conditions (a 35 cc puff volume of 2 seconds duration, followed by 58 seconds of smolder). More preferably, these cigarettes self-extinguish at the isolation segment after the burning segment is consumed when the cigarette is smoked under more rapid smoking conditions consisting of a 50 cc puff of two seconds duration, followed by 28 seconds of smolder (referred to herein as 50/30 smoking conditions).

Preferred fuel elements are provided by subdividing a continuous combustible extrudate into lengths. Preferably, the fuel elements are extruded in a manner such that the extrusion axis is parallel to the longitudinal axis of the smoking article into which the fuel element is incorporated. During extrusion, the fuel element may be provided with one or more longitudinal grooves extending along the outer periphery of the fuel element or segments thereof. Such grooves assist in allowing air to flow around the periphery of the fuel element when circumscribed by an insulating and/or retaining jacket in a smoking article. The grooves also tend to assist in retaining the fuel element within the jacket and the grooves at the lighting end aid in the lightability of the fuel element. If desired, one or more longitudinal passageways may be provided into or through the core of the fuel element in a direction parallel to the longitudinal axis of the smoking article into which the fuel element is incorporated. After the fuel elements have been extruded, transverse grooves or cuts can be made to form the isolation segments. If desired, the extrusion axis of the fuel element may be substantially perpendicular to the longitudinal axis of the smoking article into which the fuel element is incorporated. The longitudinal shape in such fuel elements is provided when the extrudate is cut into lengths corresponding to the fuel elements. Thereafter, longitudinal grooves may be made on the fuel element periphery.

The length of each of the end segments of the fuel element is typically from about 2 mm to about 15 mm, preferably about 2.5 mm to about 8 mm, prior to burning. The length of any intermediate segment of the fuel element may be as long or as short as desired, but is typically from about 1 mm to about 10 mm, preferably from about 2 to about 5 mm. Normally, the length of the isolation segments of the fuel element is from about 0.5 mm to about 10 mm, preferably from about 1.0 mm to about 5 mm.

As described above, the maximum cross-sectional dimensions of the different segments of the fuel element vary. Since the preferred end segments are essentially the same in size and shape, the cross-sectional area of each of these segments is about the same, and usually ranges from about 8 $mm^2$ to about 30 $mm^2$. The cross-sectional area of the isolation segments is typically from about 20% to about 55%, preferably from about 25% to about 40%, of the cross-sectional area of the end segments. Thus, a typical isolation portion has a cross sectional area of from about 2 $mm^2$ to about 16.5 $mm^2$. The cross-sectional area of the intermediate segment typically ranges from about 8 $mm^2$ to about 30 $mm^2$ As described above, the fuel element is retained within the cigarette of the present invention by a retaining means. Preferably the retaining means circumscribes the entire longitudinal periphery of the fuel element, and advantageously extends beyond each end of the fuel element, effectively recessing the fuel element, separating it from the other components of the cigarette. The preferred resilient nature of the retaining means allows it to extend into any grooves on the periphery of the fuel element, and particularly into the isolation segments, i.e., the portions or segments of reduced cross-sectional area and/or reduced circumference. The preferred retaining means also aids in retaining heat and limiting the amount of radial atmospheric air which could otherwise flow to the fuel element during use. The preferred retaining means thus acts as an insulating member.

In one especially preferred embodiment, the resilient insulating and retaining means comprises a fibrous material which circumscribes the longitudinal periphery and extends beyond the ends of the fuel element; and the longitudinally segmented nature of the fuel element provides for the maintenance of that fuel element securely in place within the fibrous material. The fibrous material may comprise glass fibers (Owens-Corning "C" glass is especially preferred), a tobacco filler/glass fiber mixture, gathered or shredded tobacco paper, gathered or shredded carbon paper, tobacco cut filler, or the like.

The smoking article further includes an aerosol generating means which includes a substrate and at least one aerosol forming material. A preferred aerosol generating means includes an aerosol forming material (e.g., glycerin), tobacco in some form (e.g., tobacco powders, tobacco extract or tobacco dust) and other aerosol forming materials and/or tobacco flavoring agents, such as cocoa, licorice and sugars. The aerosol forming material generally is carried by a substrate, such as gathered paper, gathered tobacco paper, or another form of substrate. Tobacco material can surround the fuel element, the substrate, and/or be employed elsewhere in the smoking articles of the present invention.

Preferably the substrate is a monolithic substrate such as a gathered paper. When the substrate is a paper-type material, it is highly preferred that such substrate be positioned in a spaced apart relationship from the fuel element. A spaced apart relationship is desired to minimize contact between the fuel element and the substrate, thereby preventing migration of the aerosol forming materials to the fuel as well as limiting any scorching or burning of the paper substrate. The spacing may be provided by any number of methods including; (a) the recessed nature of the fuel element in the insulating and retaining means, (b) by creating a physical space (i.e., a gap) between the fuel element and the substrate during manufacture, or (c) otherwise, as desired.

A preferred smoking article includes a mouthend piece for delivering aerosol to the mouth of the smoker. Typically, the mouthend piece has a generally tubular shape, and contains tobacco materials (e.g., a cylindrical charge of gathered tobacco) and a filter element.

In all of the smoking articles of the present invention convective heat is the predominant mode of energy transfer from the burning fuel element to the aerosol generating means disposed longitudinally behind, (and preferably spaced apart from) the fuel element. As described above, this heat volatilizes the aerosol forming material(s) and any flavorant materials carried by the substrate, and these volatilized materials are condensed to form a smoke-like aerosol whiqh is drawn through the smoking article during puffing, and which exits the mouthend piece.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the term "carbonaceous" means comprising primarily carbon.

As used herein, the term "symmetrical" means that the fuel elements of the present invention are capable of either division or rotation on a plane or axis, into similar halves. Thus, the term is used to define fuel elements which may be disposed within a cigarette in more than one longitudinal orientation, without altering the burning characteristics of the fuel element.

DETAILED DESCRIPTION OF THE PREFERRED EMBODIMENTS

Figure 1:
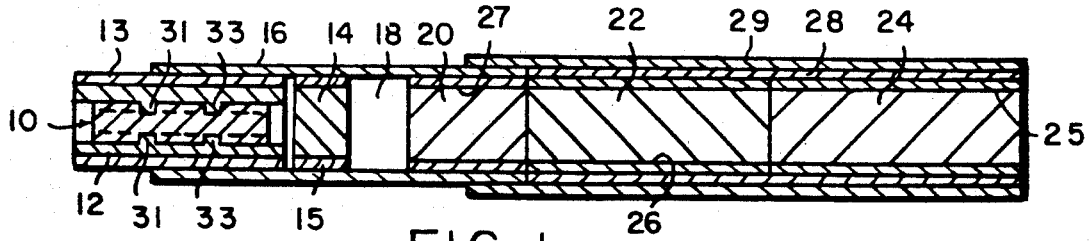
FIG. 1 is a longitudinal sectional view of one cigarette embodiment of the present invention.
Figure 1A:
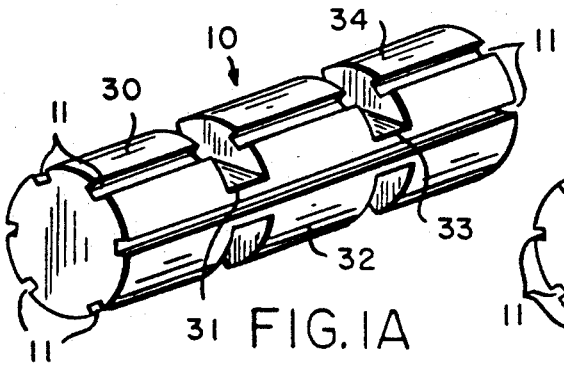
FIG. 1A is a perspective view of a symmetrical longitudinally segmented fuel element useful in the cigarette illustrated in FIG. 1.

Referring in detail to FIGS. 1 and 1A, there is respectively illustrated one preferred embodiment of the cigarette of the present invention and a symmetrical fuel element therefor. As illustrated, the cigarette includes a segmented symmetrical fuel element 10 circumscribed and recessed within a retaining jacket of insulating material 12. The insulating and retaining jacket material 12 is glass fibers.

As illustrated in FIG. 1A, the fuel element 10, which preferably is a longitudinally extruded carbonaceous material, has a generally cylindrical shape and has several longitudinally extending peripheral channels 11. The fuel element has a symmetrically segmented design which includes three longitudinally positioned portions or segments, consisting of two identical end portions 30 and 34 and one intermediate portion 32, all having essentially the same cross-sectional area. When positioned in the cigarette of FIG. 1, one of the end portions 30 or 34 serves as the burning segment, while other 34 or 30 serves as the base segment. Intermediate segment 32 is separated (isolated) from each of the end segments by two essentially identical areas of reduced cross-sectional area 31 and 33, which serve as isolation segments.

As shown in FIG. 1, the insulating and retaining jacket 12 circumscribes the longitudinal periphery of fuel element 10 and extends beyond each end of the fuel element, such that the fuel element is recessed within the insulating and retaining jacket. Such placement assists in the retaining function of the jacket. Preferred fibrous (e.g., glass fibers) jackets shrink slightly when exposed to the heat of the burning fuel element, thereby further surrounding the fuel element and retaining it in place.

Situated longitudinally behind the fuel element 10 is an aerosol generating means, which comprises substrate 14, advantageously made from a roll or gathered web of cellulosic material, e.g., paper or tobacco paper. The substrate 14 holds one or more aerosol forming materials (such as glycerin) and a form of tobacco (such as tobacco powder, extract or dust), and flavor components, which are volatilized by heat generated by the burning of the fuel element. The substrate 14 is positioned within the cigarette at a location remote from the rear end of the fuel element 10. This spaced apart relationship prevents migration of the aerosol forming material(s) from the substrate to the fuel element and assists in preventing the substrate from scorching or burning.

Surrounding the insulating and retaining jacket 12 is an air permeable paper wrapper 13. Wrapper 13 may comprise one layer or it may be prepared from two separate layers, each having different porosity and ash stability characteristics. Circumscribing the insulated fuel element at about the junction of the burning segment 30 and the isolation segment 31, and extending back over the substrate 14 is a non-burning or foil-backed (e.g., aluminum or other metal) paper wrapper 16. Wrapper 16 is preferably a non-wicking material which prevents the wicking of the aerosol forming material(s) on the substrate 14 to the fuel element 10, the insulating jacket 12, and/or from staining of the other components of the front end assembly. This wrapper also minimizes or prevents peripheral air (i.e., radial air) from flowing to the segments of the fuel element disposed longitudinally behind the burning segment, thereby causing oxygen deprivation and preventing excessive combustion. While not preferred, wrapper 16 may extend over the burning end of the fuel element 10 (or beyond the same) and be provided with a plurality of perforations (not shown) to allow controlled radial air flow to the burning segment of the fuel element to support combustion.

Situated longitudinally behind the substrate 14 is a void space 18, which as shown in FIG. 1 may be partially filled with a roll of gathered or shredded tobacco paper 20. Void space 18 acts as a cooling and nucleation chamber wherein the hot volatile materials exiting the substrate cool down and form an aerosol. The presence of tobacco paper 20 within the void space contributes tobacco flavors to the aerosol.

Positioned at the extreme mouth end of the cigarette is a two part mouthend piece comprising (i) a rod or roll of tobacco, such as tobacco paper 22 and (ii) a low-efficiency filter element 24 including a filter material, such as a gathered web of non-woven polypropylene fibers.

Each of the above described elements of the cigarette of the present invention is generally provided with a paper overwrap, and individual overwrapped segments are typically combined by the use of paper overwraps. Advantageously, the paper overwrap of the substrate is a non-wicking paper. These papers are shown in FIG. 1 as reference numbers 25–29.

In use, the smoker lights fuel element 10 (e.g., using a cigarette lighter) and the burning segment 30 burns to produce heat. During draw, air passes along the periphery of the burning segment 30 (including down channels 11) as well as through the retaining and insulating jacket 12. The drawn air is heated by contacting the burning segment of the fuel element and by heat radiated from the fuel element. The heated air transfers heat by convection to the substrate 14 and this transferred heat volatilizes the aerosol forming and flavor materials carried by the substrate. The volatilized material within the hot drawn air exits the substrate and then cools during passage through void space 18, forming an aerosol. The aerosol passes through the gathered tobacco papers 20 and 22 absorbing tobacco flavors, and passes through the filter material 24, and into the mouth of the smoker.

Since the base portion of the fuel element does not burn during the use of the cigarette, the fuel element remains securely in the cigarette and does not have a tendency to become dislodged from the cigarette during use. When the fuel element self-extinguishes and no longer generates heat, the cigarette is disposed of.

Figure 2:
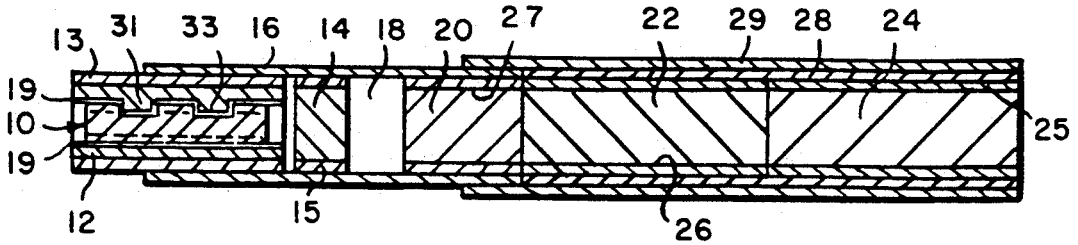
FIG. 2 is a longitudinal sectional view of another cigarette embodiment of the present invention.
Figure 2A:
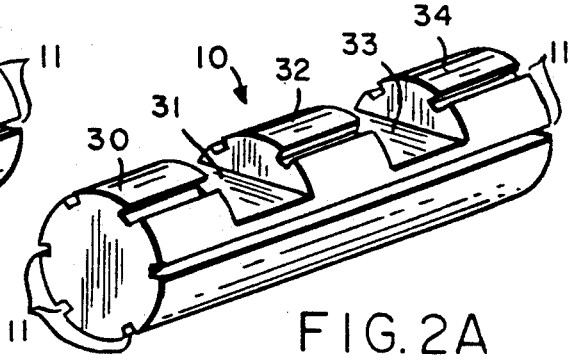
FIG. 2A is a perspective view of a symmetrical longitudinally segmented fuel element useful in the cigarette illustrated in FIG. 2.

Referring in detail to FIGS. 2 and 2A, there is respectively illustrated another preferred embodiment of the cigarette of the present invention and a symmetrical fuel element therefor. As with the fuel element of FIG. 1A, the FIG. 2A fuel element includes several longitudinally extending peripheral grooves 11.

As illustrated in FIG. 2, the cigarette includes a segmented symmetrical fuel element 10 surrounded by and recessed within a retaining jacket of insulating material 12. In this embodiment, there is at least one liner or layer of tobacco paper 19 interposed between the fuel element 10 and the insulating and retaining jacket material 12. In this embodiment, there is direct contact between the fuel element and combustible tobacco paper layer 19. Tobacco paper 19 extends beyond each end of the fuel element, and is designed to burn, such that it assists in the lighting of the fuel element, and it contributes tobacco flavor components to the aerosol. The presence of the tobacco layer or liner between the fuel element and the retaining jacket also assists in channeling the drawn hot air along the peripheral grooves to the substrate.

As illustrated in FIG. 2A, the fuel element 10, has a symmetrically segmented design which includes three longitudinally positioned portions or segments, consisting of two essentially identical end portions 30 and 34 and one intermediate portion 32, all having substantially the same cross-sectional area. When positioned in the cigarette of FIG. 2, one of the end portions 30 or 34 serves as the burning segment, while other 34 or 30 serves as the base segment. Intermediate segment 32 is separated (isolated) from each of the end segments by two identical areas of reduced cross-sectional area 31 and 33, which serve as isolation segments.

The other components of the FIG. 2 cigarette are essentially the same as those of the FIG. 1 cigarette. The substrate 14 is positioned within the cigarette at a location remote from the rear end of the fuel element 10. Surrounding the insulating and retaining jacket 12 is an air permeable outer paper wrapper 13.

Circumscribing a portion of the insulated fuel element, from about the junction of burning segment 30 and isolation segment 31, and extending back over the substrate 14 is a non-burning or foil-backed paper wrapper 16. As in FIG. 1, paper 16 prevents wicking of the aerosol forming materials from the substrate to the other front end components. This air impermeable paper also aids in extinguishing the fuel element at the isolation segment by preventing radial air flow to that portion of the fuel.

Situated longitudinally behind the substrate 14 is a void space 18, which may be partially filled with a roll of tobacco paper 20. Finally, as with the embodiment of FIG. 1, a two piece mouthend piece comprising (i) a rod or roll of tobacco, such as tobacco cut filler 22 and (ii) a low-efficiency filter element 24 including a filter material, such as a gathered web of non-woven polypropylene fibers, is positioned at the mouth end of the cigarette.

Figure 3:
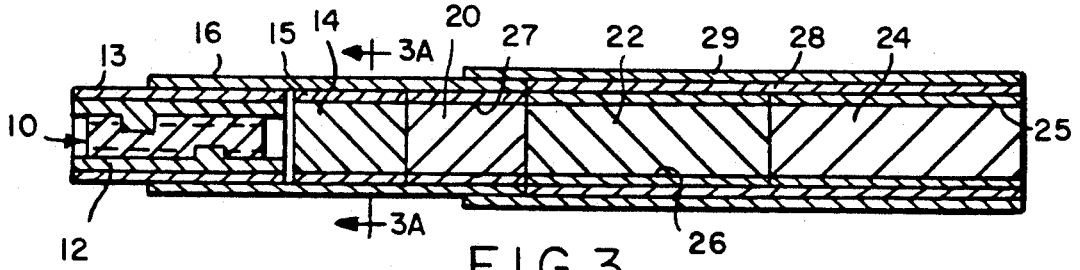
FIG. 3 is a longitudinal sectional view of another cigarette embodiment of the present invention.
Figure 3A:
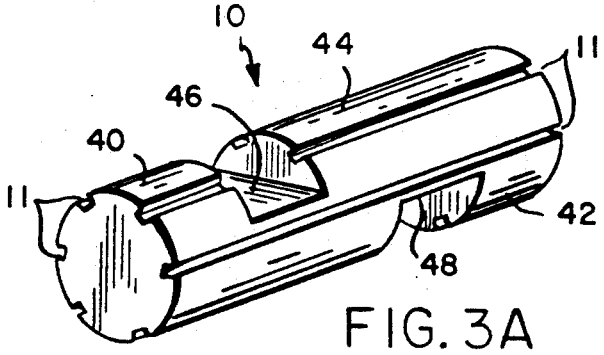
FIG. 3A is a perspective view of a symmetrical longitudinally segmented fuel element useful in the cigarette illustrated in FIG. 3.

Referring in detail to FIGS. 3 and 3A, there is respectively illustrated another preferred embodiment of the cigarette of the present invention and a symmetrical fuel element therefor. As with the fuel element of FIGS. 1A and 2A, the FIG. 3A fuel element includes several longitudinally extending peripheral grooves 11.

As illustrated in FIG. 3A, fuel element 10 is of a segmented symmetrical design having identical end segments 40 and 42, an intermediate segment 44 and two isolation segments 46 and 48.

Figure 3B:
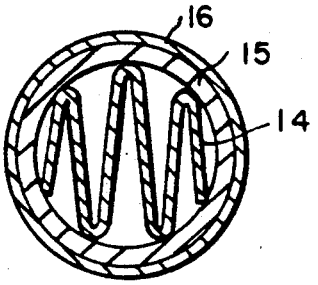
FIG. 3B is a sectional view of the substrate element and its circumscribing wrapper as taken along section line 3B—3B in the cigarette illustrated in FIG. 3.

As illustrated in FIG. 3, fuel element 10 is surrounded by and recessed within a retaining jacket of insulating material 12. This embodiment differs from the previous embodiments in several ways; (1) the substrate 14 is longer in length and smaller in diameter than previously shown; the substrate 14 is circumscribed by a roll of tobacco or a non-wicking tobacco liner 15 such as that shown in FIG. 3B; and (3) wrapper 16 is not a foil-lined paper, but is instead a non-wicking paper treated so as to be substantially non-burning.

In this embodiment, the circumscribing roll of tobacco 50 around substrate 14 is provided to contribute tobacco flavor components to the aerosol and to prevent wicking of the aerosol forming materials from the substrate to the other components of the cigarette. Hot gases passing through the front end of the cigarette pass through the tobacco roll, releasing tobacco flavor components. Also, in this cigarette, the void space behind the substrate has been completely filled with substrate 14, its circumscribing tobacco roll 50, and tobacco plug 20.

The remaining components of the FIG. 3 cigarette and their placement in the cigarette are essentially the same as those of the FIG. 1 and 2 cigarettes.

Figure 4:
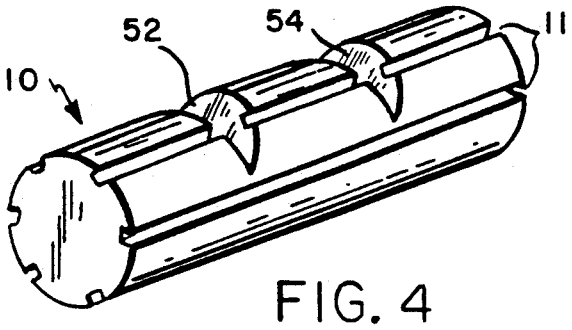
FIGS. 4–7 are perspective views of other segmented fuel elements useful in the cigarettes illustrated in FIGS. 1–3.
Figure 5:
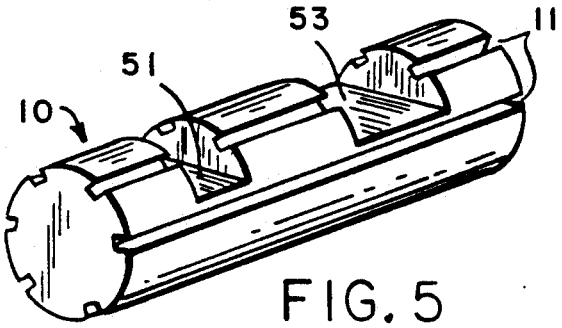
Figure 6:
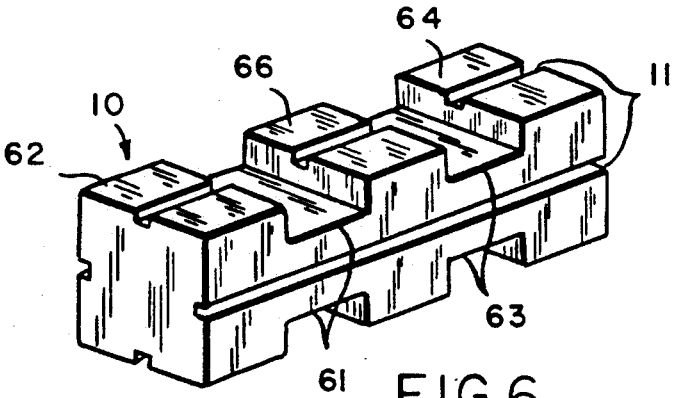
Figure 7:
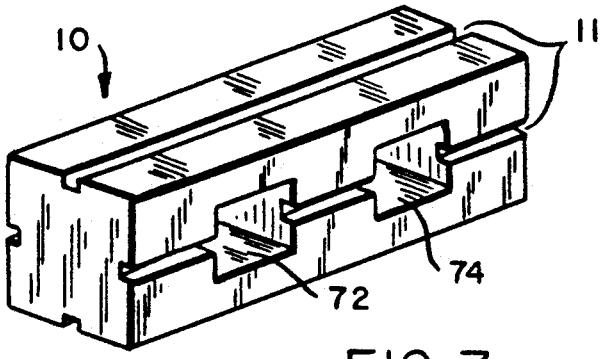

FIGS. 4 and 6–7 illustrate alternative embodiments of symmetrically segmented fuel element designs useful in the cigarettes of the present invention. FIG. 5 illustrates an unsymmetrical fuel element design, which has similar end segments, and thus qualifies for use herein without regard to longitudinal orientation.

Referring to FIG. 4, fuel element 10 has a generally cylindrical cross-sectional shape and includes air flow channels 11 extending as equally spaced apart grooves along the longitudinal periphery of the fuel element. This fuel element is further provided with two equally sized "v"-shaped cut-out sections 52 and 54, placed equally distant from each end of the fuel element. As such, the isolation segments are formed with a non-uniform cross-sectional area, which depends upon the size and shape of the portion removed from the fuel element to form the isolation segments.

FIG. 5 represents another fuel element 10 having a generally cylindrical cross-sectional shape, and includes air flow grooves along the periphery of the fuel element and/or its segments. As illustrated, the end segments of this fuel element are substantially the same in size, shape, and cross-sectional area. The fuel element is not symmetrical, due to the difference in lengths of the two isolation segments 51 and 53. As illustrated, isolation segment 53 is at least three times (3×) the length of isolation segment 51. However, the cross-sectional area of the two isolation segments are substantially the same.

FIG. 6 illustrates a symmetrically segmented fuel element 10 which has a generally rectangular cross-sectional shape, two isolation segments 61 and 63, and includes several peripheral airflow channels 11 extending as grooves along the longitudinal periphery of the fuel element. The cross-sectional areas of the end segments 62 and 64 and the intermediate segment 66 are essentially the same. While grooves 11 are shown on each face of this fuel element, they may be arranged in any desired manner, e.g., with two sets of grooves on the top and bottom (i.e., the cut-out) faces (not shown) or otherwise as desired.

This fuel element can be manufactured by extruding a combustible extrudate and subdividing the extrudate into fuel elements of the desired widths. In particular, the fuel element is provided by extruding an extrudate having a cross-sectional shape identical to the longitudinal shape of the fuel element shown in FIG. 6, and the extrudate is subdivided into fuel elements of the desired widths. As such, the longitudinal axis of the fuel element is essentially perpendicular to the extrusion axis thereof. Airflow passageways 11 are then machined into the fuel element.

Referring to FIG. 7, fuel element 10 has a generally rectangular cross-sectional shape and includes several air flow channels 11 extending as equally spaced apart grooves along the longitudinal periphery of the fuel element. This fuel element is further provided with two equally sized transversely extending windows 72 and 74 placed equally distant from each end of the fuel element. While grooves 11 are shown on each face of this fuel element, they may be arranged in any desired manner, e.g., with two sets of grooves on the top and bottom (i.e., the non-cut-out) faces (not shown) or otherwise as desired.

The skilled artisan will readily recognize that the various component parts of the cigarettes of FIGS. 1–3 and the fuel elements of FIGS. 4–7 are typically interchangeable. Any of the fuel elements described above may be used in any cigarette embodiment, and the component parts of one cigarette may be readily substituted or added to another as necessary or desired.

Figure 8:
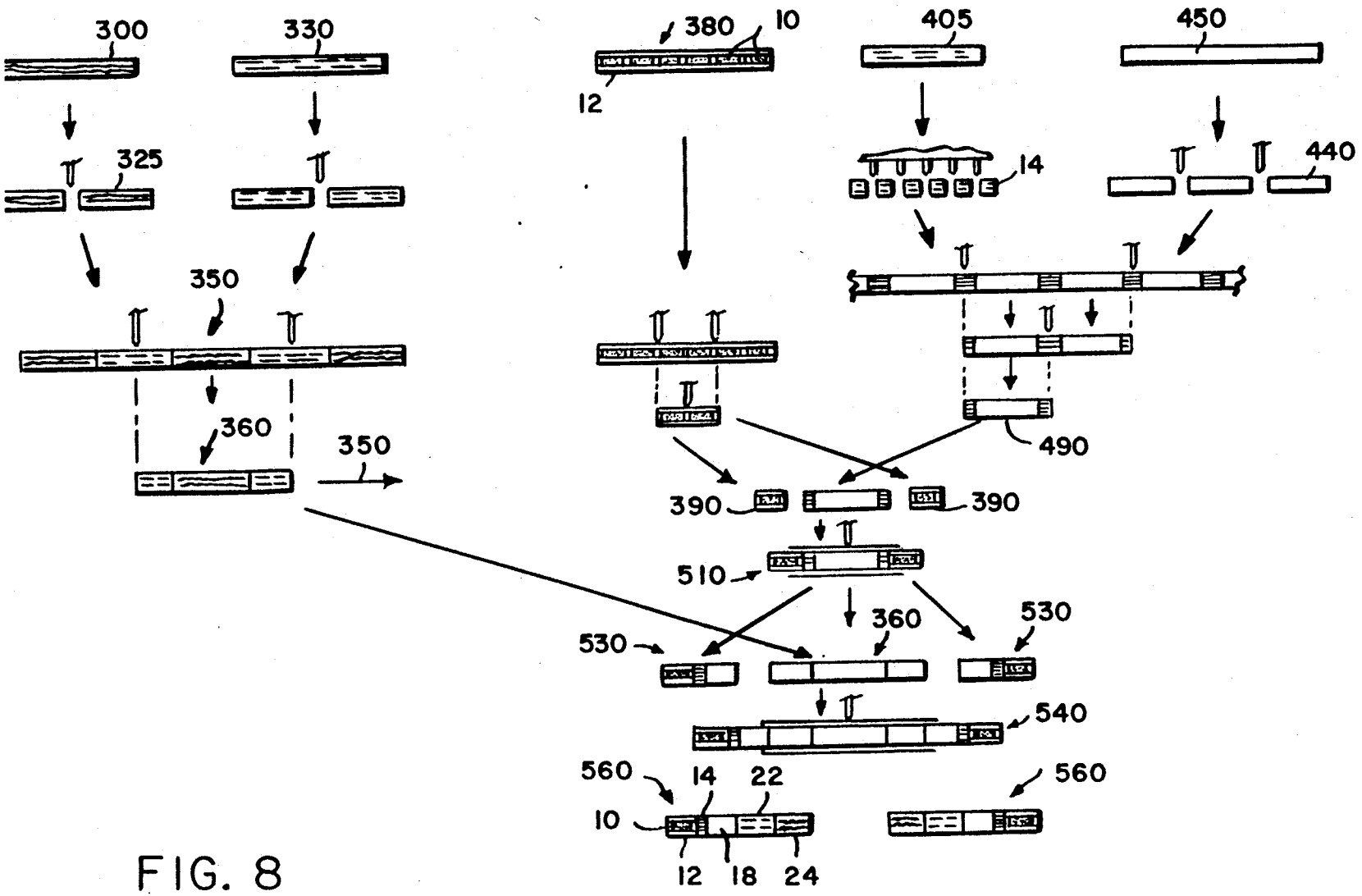
FIG. 8 is a schematic diagram of a method of preparing cigarettes of the present invention.

Referring to FIG. 8, there is shown a flow diagram of one preferred method for manufacturing the cigarette embodiments of the present invention. The method involves separately manufacturing the fuel element and substrate components, as well as a mouthend piece followed by the combination of the individually prepared components.

As illustrated, the mouthend piece is manufactured by providing filter rods 300 which include a filter material (e.g., polypropylene web, polypropylene tow, plasticized cellulose acetate tow, cellulose acetate web, or gathered paper) circumscribed by an outer plug wrap (e.g., paper plug wrap). Methods for making suitable filter rods are described in U.S. Pat. No. 4,807,809 to Pryor et al., using known processing and rod making apparatus, and apparatus such as CU-10 or CU-20S from Decoufle s.a.r.b. and a rod making apparatus, such as the KDF-2, from Hauni-Werke Korber & Co., KG. The filter rods then are subdivided into cylindrical elements 325 of the desired lengths (e.g., about 40 mm).

Tobacco paper rods 330, which include gathered tobacco paper within a circumscribing plug wrap, are made, e.g., using the apparatus described in U.S. Pat. No. 4,807,809 to Pryor et al. Such tobacco paper rods then are subdivided into cylindrical elements 340 of the desired lengths (e.g., about 40 mm). The cylindrical filter elements 325 and tobacco paper elements 340 are combined 350 using a circumscribing paper wrap, e.g., using a Mulfi from Hauni-Werke Korber & Co., KG, or other suitable plug tube combination apparatus. The resulting combined rods are subdivided into "2-up" mouthend piece rods 360 (e.g., having a 40 mm filter segment and a 20 mm tobacco paper segment at each end thereof).

A continuous rod 380 including a plurality of longitudinally aligned cylindrical fuel elements is . prepared by inserting individual fuel elements 10 at predetermined intervals within an insulating member, preferably using techniques and equipment described in greater detail hereinafter with reference to FIGS. 9, 9A and 9B. The continuous rod 380 is subdivided at the intervals between the fuel elements into cylindrical segments 390 of the desired lengths (e.g., about 15 mm) having the fuel element 10 recessed within the insulating member 12.

Substrate rods 405 which include a substrate material (e.g., gathered paper) carrying aerosol forming material (e.g., glycerin and a tobacco extract) circumscribed by an outer wrapper made from a non-wicking material (e.g., foil-lined paper, treated paper, etc.) are also prepared. One method for making suitable substrate rods 405 involves embossing and folding a continuous web of paper substrate material, applying liquid aerosol forming material to the substrate material, and forming the material into a continuous rod using known rod making techniques. The rods 405 are subdivided into cylindrical substrate elements 14 of the desired lengths (e.g., about 10 mm to about 20 mm).

A hollow paper tube 450 or a short hollow paper tube combined with a short tobacco rod element (not shown) can be used in this method. Alternatively, tobacco rods (not shown) which include a roll or charge of tobacco cut filler wrapped in a circumscribing paper wrapper, manufactured using known techniques could be used in place of the hollow paper tube. Methods for providing hollow paper tubes will be apparent to the skilled artisan. Tubes 450 are subdivided into cylindrical segments 440 of the desired lengths (e.g., about 30 to about 40 mm). The substrate elements 14 and tube 440 are combined using a circumscribing paper wrap. The resulting combined rods are subdivided into "2-up" substrate rods 490 (e.g., rods each having a 30 mm to 40 mm hollow paper tube segment and a 5 mm to 10 mm substrate segment at each end thereof).

The method also involves combining the "2-up" substrate rod 490 to with cylindrical fuel segments 390 using a foil-lined paper and a tipping apparatus such as a Max 80 from Hauni-Werke Korber & Co., KG, to provide a "2-up" fuel-substrate assembly 510. The "2-up" fuel-substrate assembly includes, in longitudinal alignment, a jacketed fuel element 390, a substrate 14, a hollow tube (or void space) 18, a substrate 14, and a jacketed fuel element 390. The jacketed fuel element and adjacent substrate can either abut or be spaced apart.

The "2-up" fuel-substrate assembly 510 is divided through the hollow tube segment to provide two cigarette front end assemblies 530. Each front end assembly 530 is positioned at each end of the "2-up" mouthend piece rod 360, and the pieces are combined using a tipping apparatus, to provide a "2-up" finished cigarette 540. The "2-up" finished cigarette 540 is divided through the filter element to provide two finished cigarettes 560. The finished cigarettes have a longitudinal alignment comprising, a jacketed fuel element 10, 12, a substrate 14, a void space 18, and a two part mouthend piece comprising a gathered tobacco paper element 22 and a filter segment 24.

Figure 9:
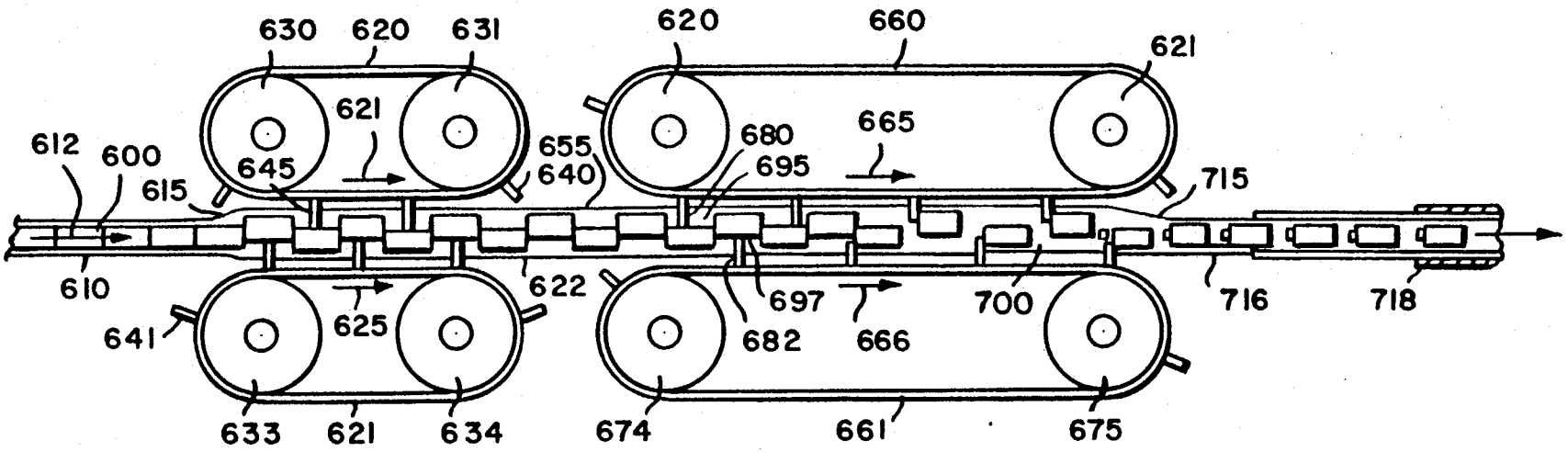
FIGS. 9, 9A and 9B are schematic diagrams of an apparatus used for preparing insulated fuel elements.
Figure 9A:
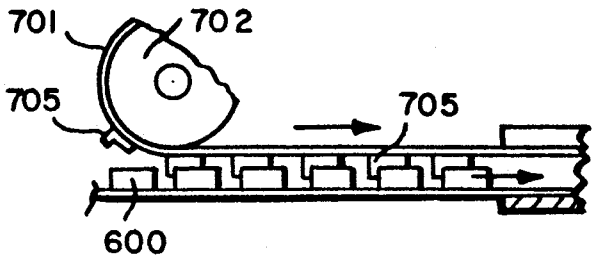
Figure 9B:
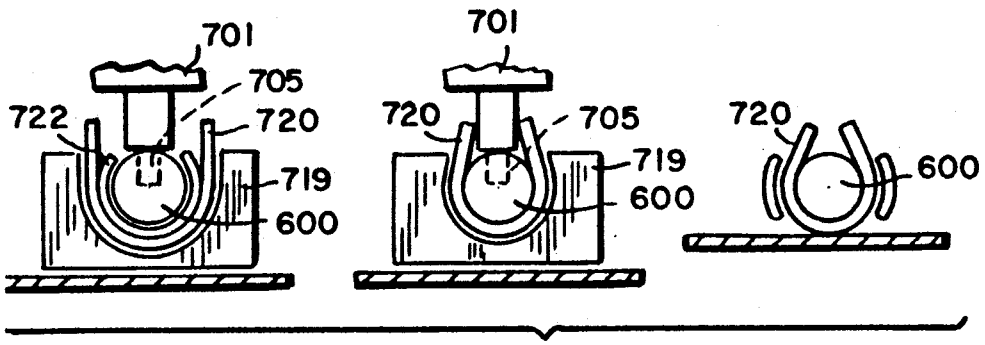

Referring to FIGS. 9, 9A and 9B there is shown an apparatus for providing a continuous rod of jacketed fuel elements. A plurality of fuel elements 600 are provided from an infeed region (not shown) are aligned in an abutting end-to-end relationship in a trough 610. The manner in which the fuel elements 600 are provided can vary, and can involve the use of a centrifugal feeder (not shown), such as a Model FT Series 30 Centrifugal Feeder from Hoppman Corp., which aligns the fuel elements in a end-to-end relationship and introduces those fuels into a conveyor infeed system including the single lane trough 610. The trough 610 has dimensions such that the fuel elements are in essentially perfect longitudinal alignment and are not offset relative to one another. The fuel elements are moved in the direction shown by arrow 612 using control belts (not shown) or other suitable means to control delivery speeds of those fuels.

At region 615 the trough increases in width, normally by about 1.5 to about 1.75 times that of the width of the single lane trough. Shuttle belts 620, 621 positioned on each side of widened trough 622 are moved in the direction shown by arrows 624, 625, respectively. Belt 620 is positioned on sprockets 630, 631, on one side of the trough; and belt 621 is positioned on sprockets 633, 634 on the other side of the trough. Each of the sprockets are rotated using a power source (not shown), a timing means (not shown) and a drive means (not shown). The particular power source, timing means and drive means can vary and can be advised as necessary.

Each of the shuttle belts 620, 621 includes a plurality of spaced pusher tabs, dogs, lugs or pins 640, 641 extending outwardly therefrom. The belts are positioned relative to one another so that the pins on each opposing belt are offset relative to one another. The offset positioning of the pins on each belt is essentially equal to the length of each fuel element 600. The linear speed of each belt (i.e. in the direction of arrows 624, 625) is essentially equal to the speed of the fuel elements through widened trough 622. The height of the trough is such that the fuel elements remain therein, while the trough is sufficiently shallow so that the pins from the belts can enter the sides of the trough to contact the fuel elements therein. The speed of each of the shuttle belts is synchronized so that pins 640 of belt 620 push each fuel element to the opposite side 645 of the trough, while pins 641 of belt 621 push each fuel element to the opposite side 646 of the trough. As such, each respective fuel element is shuttled, axially offset relative to the fuel elements preceding and following it through the trough, as shown in region 655.

Spacer belts 660, 661 positioned on each side of the widened trough 622 downstream from shuttle belts 620.and 621 each are moved in the direction shown by arrows 665, 666, respectively. Spacer belt 660 is positioned on sprockets 670, 671 on one side of the widened trough 622; and spacer belt 661 is positioned on sprockets 674, 675 on the other side of the trough. Each of the sprockets are rotated using a power source (not shown), a drive means (not shown), and a timing means (not shown). Each of the spacer belts 660, 661 includes a plurality of spaced pusher tabs, dogs, lugs or pins 680, 682 extending outwardly therefrom. The belts are positioned relative to one another so that the pins on each opposing belt are offset relative to one another. The offset positioning of the pins on each belt is essentially equal to the length of each fuel element plus the ultimate spacing which is desired between the fuel elements in the continuous rod. Spacer pins 680 from belt 660 enter void region 695 in the trough opposite the fuel element therein; and pins spacer 682 from belt 661 enter void region 697 in the trough opposite the fuel element therein. The linear speed of each spacer belt 660, 661

(i.e., in the direction of arrows 665, 666) is synchronized relative to one another and is greater than that of the fuel elements moving through the trough.

Because the spacer belt is driven at a faster linear speed than the fuel element, the spacer pin contacts the back face of the fuel element to accelerate that fuel and create a space between that fuel and the fuel which follows it. Thus, longitudinally offset fuel elements are provided in a spaced apart relationship in region 700 of the trough.

An overhead belt 701 (see FIG. 9A), similar to the previously described belt 620, is positioned immediately above the trough and carried on sprockets 702 in a manner described previously with regards to the shuttle and spacer belts. The overhead belt is positioned above the trough so that pins 705 which extend from the belt can extend downward into the trough. Each pin 705 from that belt contacts the back face of each fuel elements after each pin 680 or 682 from each spacer belt 660 or 661 ceases contact with that fuel element. As such, the fuel elements are moved downstream by the pins extending from the moving overhead belt in a desired spaced apart relationship.

The trough 622 also narrows in region 715 into narrow trough 716 so that the spaced apart fuel elements so that the spaced apart fuel elements are axially aligned.

The plurality of spaced apart fuel elements are moved through the trough 716 by the pins 705 extending from the belt 701 into a rod pre-forming section 718 including an open top tube 722 (See FIG. 9B) and a garniture 719 for preforming a continuous web 720 of insulating material around a significant amount of the circumference of the tube. Then, the open top tube ends and the garniture narrows so that the gathered insulator web circumscribes the fuel elements as they leave the tube, and the fuel elements are maintained in the desired spaced apart relationship in the insulator web. In addition, the overhead belt turns upwards at the region where the open top tube ends so that each pin which moves each fuel element 610 no longer contacts that fuel element. Then the continuous insulator web is closed by a tongue as described in U.S. Pat. No. 4,893,637 to Hancock et al. The closed insulator web enters the garniture region of a rod making apparatus, such as KDF-2 from Hauni-Werke Korber and Co. KG where a circumscribing outer wrapper is applied, providing a continuous rod.

The fuel elements of the present invention should meet three criteria; (1) they should be easy to ignite, (2) they should supply enough heat to produce aerosol for about 5–15, preferably about 8–12 puffs; and (3) they should not contribute off-taste or unpleasant aromas to the cigarette. Fuel elements prepared from a combustible composition comprising carbon and a binder, or carbon, tobacco and a binder are preferred, but other combustible compositions may be used.

If desired, a non-burning filler material such as calcium carbonate, agglomerated calcium carbonate, or the like, may be added to the fuel composition to assist in controlling the calories generated by the fuel element during combustion, by reducing the amount of combustible material present therein. The filler material typically comprises less than about 50 weight percent of the fuel composition, preferably less than about 30 weight percent, and most preferably from about 5 to about 20 weight percent. See, U.S. patent application Ser. No. 07/567,520, filed Aug. 15, 1990.

Preferred fuel elements used herein comprise carbonaceous materials. The preferred carbonaceous materials have a carbon content above about 60 weight percent, more preferably above about 70 weight percent, and most preferably above about 80 weight percent. Flavors, tobacco materials, fillers (e.g. clays or calcium carbonate), burn additives, combustion modifying agents, and the like, may be incorporated into the fuel element.

The density of the preferred fuel elements is generally greater that about 0.5 g/cc, preferably greater than about 0.7 g/cc and most preferably greater than about 1 g/cc, but typically does not exceed 2 g/cc. The length of the fuel element, prior to burning, is generally less than about 25 mm, often less than about 17 mm, and is typically about 10–12 mm or less.

Exemplary compositions of carbonaceous fuel elements are set forth in U.S. Pat. No. 4,714,082 to Banerjee et al.; as well as in European Patent Publication Nos. 236,992 and 407,792; which are incorporated herein by reference. Other exemplary carbonaceous materials are coconut hull carbons, such as the PXC carbons available as PCB and the experimental carbons available as Lot B-11030-CAC-5, Lot B-11250-CAC-115 and Lot 089-A12-CAC-45 from Calgon Carbon Corp.

Other fuel elements can be provided from comminuted tobacco material, reconstituted tobacco material, heat treated or pyrolyzed tobacco materials, cellulosic materials, modified cellulosic materials, and the like. Exemplary materials are set forth in U.S. Pat. No. 3,931,824 to Miano et al., as well as in Sittig, *Tobacco Substitutes*, Noyes Data Corp. (1976).

One suitable fuel composition comprises from about 60 to about 99 weight percent carbon; from about 1 to about 20 weight percent of a suitable binder; from about 1 to about 5 weight percent of an ammonia releasing compound; and from about 2000 to about 20,000 ppm sodium (Na) as measured using inductively coupled plasma atomic emission spectroscopy (ICP-AES). Compounds capable of releasing ammonia under the burning conditions of the fuel composition include compounds such as urea, inorganic and organic salts (e.g., ammonium carbonate, ammonium alginate, or mono-, di-, or tri-ammonium phosphate); amino sugars (e.g., prolino fructose or asparigino fructose); amino acids, particularly alpha amino acids (e.g., glutamine, glycine, asparagine, proline, alanine, cystine, aspartic acid, phenylalanine or glutamic acid); di-, or tri-peptides; quaternary ammonium compounds, and the like. These fuel compositions are described in detail in Riggs et al., U.S. patent application Ser. No. 07/722,993, now U.S. Pat. No. 5,178,167, filed concurrently herewith, the disclosure of which is hereby incorporated herein by reference.

The carbonaceous fuel elements for smoking articles of the present invention may be molded, machined, pressure formed or extruded into the desired shape. Molded fuel elements can have channels, slots, grooves or hollow regions therein.

Preferred extruded carbonaceous fuel elements can be prepared by admixing up to 95 parts carbonaceous material, up to 20 parts binder and up to 20 parts tobacco (e.g., tobacco dust and/or a tobacco extract) with sufficient water (or aqueous $Na_2CO_3$ solution) to provide an extrudable mixture. This mixture can then be extruded using a ram, screw or piston type extruder into an extrudate of the desired shape having the desired number of channels or void spaces.

Extruded fuel elements can be provided as follows. Carbon particles are provided in a particulate form by ball milling techniques. Tobacco laminae can also be ball milled to a fine particle size (e.g., 5 to 15 μm, preferably 7 to 12 μm—average) and mixed with the carbon particles. Other fuel element components or additives (e.g., calcium carbonate particles or graphite fibers) can be blended with the carbon particles or mixture of carbon and tobacco particles. The particles then are physically mixed with dry, powdered binding agent. Then, the resulting dry blend is physically mixed while an atomized spray of water is applied thereto. The resulting damp mix typically exhibits a moisture content of about 30 to about 35 weight percent. If desired, water soluble materials or additives (e.g., tobacco extracts, salts, and the like) can be incorporated into the mix by dissolving such materials or additives in the water.

The damp mix is preferably extruded using a compounding extruder (e.g., a double screw compounding extruder). In one aspect, the damp mix is extruded into a premixed billets using a Baker-Perkins MP-50-35 DE XLT extruder; and then the billets are extruded into the desired shape using a ram piston extruder, such as an HET-120A from Hydramet American Inc. In another aspect, the mix is extruded into the desired shape using a double screw compounding extruder equipped with a screw including a series of forward screw segments, paddle segments and feed screw segments.

The extruded mix exits a die as a continuous extrudate having the desired cross-sectional shape, and is deposited onto an airfoil. The continuous extrudate carried on the airfoil then is cut into rods of the desired length using a reciprocating flying knife. Then, the rods so provided, which usually have a moisture content of about 32 to about 34 weight percent, are placed into a recirculated air controlled humidity dryer maintained at about ambient temperature. The rods are subjected to drying conditions for about 16 hours, so as to achieve a moisture content of about 7 to about 8 weight percent.

The length of each of the end segments of the fuel element is typically from about 2 mm to about 15 mm, preferably about 2.5 mm to about 8 mm, prior to burning. The length of any intermediate segment of the fuel element may be as long or as short as desired, but is typically from about 1 mm to about 10 mm, preferably from about 2 to about 5 mm. Normally, the length of the isolation segments of the fuel element is from about 0.5 mm to about 10 mm, preferably from about 1.0 mm to about 5 mm.

The maximum cross-sectional dimensions of the various segments of the fuel element vary. Since the end segments are essentially identical, the cross-sectional area of each of these segments usually ranges from about 8 $mm^2$ to about 30 $mm^2$. Although it is desirable that the cross-sectional dimensions of the isolation portion of the fuel element be as small as possible, a typical isolation portion has a cross sectional area of about 3 $mm^2$ to about 10 $mm^2$. The cross-sectional area of the intermediate segment typically ranges from about 8 $mm^2$ to about 30 $mm^2$.

Peripheral grooves are preferably included in the finished fuel elements, and such grooves may be created during extrusion, after extrusion or at both times. It is preferred that the grooves be deeper than their width, advantageously the depth should be up to about twice (2×) the width. Typical widths for grooves on the fuel elements of this invention are from about 0.25 mm to about 1.5 mm, preferably from about 0.5 mm to about 1.0 mm. The depths of these grooves is generally within the range of about 1 mm to about 1.5 mm. The grooves may have either a rounded (concave or convex) bottom, or a square or rectangular bottom. The preferred shape is a concave bottom.

In preferred segmented fuel elements of the present invention, it has been found that when employed in the preferred cigarette embodiments, less than one-half of the total length of the fuel element burns, and preferably only about 20 to about 40% of the total length burns. This amounts in most cases to about 20% to 30% of the mass of the fuel element being consumed during use.

If desired, the fuel element can be at least partially circumscribed by a liner, such as at least one layer of paper, which surrounds the peripheral length of the fuel element (see FIG. 2). As such, the liner is positioned between the fuel element and the inner surface of the insulating and retaining material. Preferably, the one or two layers of liner extend along the length of the inner surface of the insulating and retaining material. Most preferably, the liner completely circumscribes the fuel element and extends along the total length of the inner surface of the insulating and retaining member. The liner most preferably is a tobacco paper (e.g., a tobacco/wood pulp paper available as P-2831-189-AA from Kimberly-Clark) or a carbon-containing paper (e.g., a carbon—wood pulp—tobacco stem paper available as P-2540-136E from Kimberly-Clark).

When employed in a cigarette, the fuel element (with or without a liner) is circumscribed by an insulating and/or retaining jacket material. The insulating and retaining material preferably (i) is adapted such that drawn air can pass therethrough, and (ii) is positioned and configured so as to assist in holding the fuel element in place. In some embodiments, the insulating and/or retaining material is compressed around the fuel element, thereby ensuring a good, stable positioning and snug fit of the fuel element therein.

In the cigarettes of the present invention, the fuel element is recessed within the insulating and/or retaining jacket. The length of the jacket extending beyond each end of the fuel element may be as long or as short as desired for producing various burning and heat transfer characteristics. Generally the jacket extends from about 0.5 mm to about 3 mm, preferably from about 1 to 2.5, and most preferably from about 1.5 to 2 mm beyond each end of the fuel element.

The components of the insulating and/or retaining material which surrounds the fuel element can vary. This material is preferably one which has a tendency not to combust or a material which combusts but does not disintegrate. Examples of suitable materials include glass fibers and other materials of the type described in U.S. patent application Ser. No. 07/601,551, filed Oct. 23, 1990; European Patent Publication No. 336,690; and pages 48–52 of the monograph entitled, *Chemical and Biological Studies of New Cigarette Prototypes That Heat Instead of Burn Tobacco*, R. J. Reynolds Tobacco Co. (1988).

Examples of other suitable insulating and/or retaining materials are glass fiber and tobacco mixtures such as are described in U.S. Pat. No. 4,756,318 to Clearman et al. and U.S. patent application Ser. No. 07/576,751, filed Aug. 29, 1990.

Other suitable insulating and/or retaining materials are gathered paper-type materials which are spirally wrapped or otherwise wound around the fuel element. Suitable paper-type materials include treated papers; papers containing carbonaceous materials; tobacco-containing papers; wood pulp papers; sulfate papers; wood pulp/calcium carbonate containing papers; papers containing carbonaceous materials, wood pulp, tobacco and fillers, such as those described in copending U.S. patent application Ser. No. 07/567,520, filed Aug. 15, 1990. The paper-type materials can be gathered or crimped and gathered around the fuel element; gathered into a rod using a rod making unit available as CU-10 or CU2OS from Decoufle s.a.r.b., together with a KDF-2 rod making apparatus from Hauni-Werke Korber & Co., KG, or the apparatus described in U.S. Pat. No. 4,807,809 to Pryor et al.; wound around the fuel element about the longitudinal axis of the fuel element; or provided as longitudinally extending strands of paper-type sheet using the types of apparatus described in U.S. Pat. Nos. 4,889,143 to Pryor et al. and 5,025,814 to Raker, the disclosures of which are incorporated herein by reference.

Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the fuel element within the cigarette.

As illustrated in FIGS. 1–3, the insulating and/or retaining material which surrounds the fuel element is circumscribed by a paper wrapper. This paper wrapper may comprise one or two layers, which may vary in air permeability and ash stability characteristics. Papers having these characteristics are described in U.S. Pat. No. 4,938,238 to Barnes et al. and U.S. patent application Ser. No. 07/574,327 by Barnes et al. One example of a suitable paper wrapper is available as P-850-63-5 from Kimberly-Clark Corp. A portion of this wrapper is in turn circumscribed by a second or outer paper wrapper. An example of a suitable outer paper wrapper is available as P-850-61-2 from Kimberly-Clark Corp.

The outer paper wrapper most preferably is a paper which exhibits a propensity not to burn (i.e., due to a very low porosity and/or due to chemical treatment), and preferably does not circumscribe the inner paper wrapper(s) for a length of about 2 mm to about 8 mm, more preferably about 3 mm to about 6 mm, from the extreme lighting end of the cigarette. The outer paper wrapper also circumscribes at least a portion of the length of the aerosol generating means. The outer wrapper acts to assist in preventing the fuel element from burning to any significant degree beyond the burning segment thereof.

If necessary or desired, the papers employed near the fuel element, particularly those paper wrappers which are positioned outward from the base segment of the fuel element can be coated with burn retardants, such as aqueous solutions of calcium chloride or diammonium hydrogen orthophosphate.

The smoking articles of the present invention include an aerosol generating means which is physically separate from the fuel element. As such, the aerosol generating means is not mixed with, or is not part of, the fuel element. The aerosol generating means is situated such that the heat generated by the burning fuel element is convectively transferred to the aerosol generating means for heating and volatilizing the aerosol forming material, particularly during periods of draw by the smoker.

The preferred aerosol generating means includes a substrate for carrying the aerosol forming material. Preferred substrates retain the aerosol forming material when not in use, and release the aerosol forming material during the smoking period.

One preferred type of substrate is a wicking material which has the form of a non-woven sheet-like material or a cellulosic material, such as paper, carbon paper or tobacco paper. Such a substrate typically is provided as a cylindrical segment including a shredded, gathered, pleated or crimped web of paper-type material within a circumscribing outer wrapper. Preferred substrates of this type are described in Clearman et al., U.S. patent application Ser. No. 07/655,706, filed Feb. 14, 1991, the disclosure of which is incorporated herein by reference.

Cylindrical substrate segments can be provided from rods which are manufactured using equipment and techniques described in U.S. Pat. No. 4,807,809 to Pryor et al., as well as on a rod making unit available as CU-10 or CU2OS from Decoufle s.a.r.b. coupled with a rod making apparatus such as the KDF-2 available from Hauni-Werke Korber & Co., KG. Exemplary papers which are gathered to form substrates are available as MS2408/S538 from Filtrona, Ltd. as well as P-1976-29-11, P-1976-29-5, P-1976-29-7, P-1976-29-1, P-1976-29-8, and P-3122-101-1, from Kimberly-Clark Corp.

Combinations of two or more papers or paper-type materials can be employed. Exemplary tobacco papers which are gathered to form substrates are available as P-144-GNA from Kimberly-Clark Corp., and also include the carbon filled tobacco sheet materials described in European Patent Publication No. 342,538. The paper has a composition, form and configuration such that it resists scorching during use while allowing aerosol forming material carried thereby to be released during smoking. Typically, the paper has a thickness of from about 0.001 inch to about 0.05 inch, and frequently from about 0.02 inch to about 0.03 inch. Also suitable are gathered sheet-like thermoplastic materials such as those described in U.S. patent application Ser. Nos. 07/606,287, filed Nov. 6, 1990 and 07/621,499, filed Dec. 7, 1990.

One preferred substrate is prepared by providing cellulosic paper web having a width of about 225 mm and a basis weight of about 22 g/m$^2$ (e.g., a paper available as 2-1079-C-01B from Kimberly-Clark). The web is formed into a rod circumscribed by a foil backed paper outer wrap using either a CU-10 or CU2OS from Decoufle s.a.r.b., together with the KDF-2 machine. In particular, the continuous web of substrate material is embossed; folded into a plurality of longitudinally extending folds; has aerosol forming material continuously applied to the center region thereof; and is gathered and formed into a rod circumscribed by the outer wrap. In a preferred embodiment, the paper is gathered in such a manner so as to provide a rod having a generally compressed "S"-shape when viewed end on.

The circumscribing outer wrapper over the substrate is preferably a paper material, and can be a paper material coated or otherwise treated to be non-wicking, i.e., so as to limit the migration of aerosol forming material to other parts of the smoking article. Examples of suitable materials are ethyl cellulose (e.g., which is applied as a dilute solution in alcohol), or a material which is available as Hercon 70 from Hercules, Inc.

Another suitable non-wicking circumscribing paper material is a foil-lined paper tube. Such tubes are useful to prevent migration of the aerosol forming materials to the other cigarette components, particularly the fuel element. As shown in FIGS. 1 and 2, the this foil-lined paper tube can extend up over a portion of the fuel element, where it aids in blocking radial air passage to the isolation segment of the fuel element. This limitation on radial air flow assists in the self-extinguishing nature of the fuel element. Such tubes are commercially available from the Simpson Paper Co.

As illustrated in FIGS. 1-3, the substrate is preferably positioned behind the fuel element, in a spaced apart relationship relative to the back end of the fuel element so as to have an air space or gap therebetween. This can be accomplished by abutting the substrate against the insulating jacket or by providing a gap or space between the jacketed fuel element and the substrate during manufacture. Preferably, the back end of the fuel element and the front end of the substrate are positioned from about 1 mm to about 10 mm apart, and most preferably from about 2 mm to about 5 mm apart. A void space may also be provided immediately behind the substrate. Such a void space provides a zone for aerosol formation. This void space is preferably from about 1 to about 20 mm in length, and is located forward of any tobacco cut filler, tobacco paper or the like.

Another substrate useful herein has the form of a porous, air permeable pad which wicks liquid aerosol forming material from a container. The sheet-like material used as the substrate can have inorganic or organic based fillers (e.g., alumina, clay, carbon) having certain pore structures physically mixed therewith and/or incorporated therein in order to control migration of aerosol forming material from the substrate.

The aerosol generating means also includes one or more aerosol forming materials. Examples of preferred aerosol forming materials include the polyhydric alcohols (e.g., glycerin, propylene glycol, triethylene glycol and tetraethylene glycol), the alipahtic esters of mono-, di-, or poly-carboxylic acids (e.g., methyl stearate, dimethyl dodecandioate and dimethyl tetra decanedioate), Hystar TPF available from Lonza, Inc., and the like, as well as mixtures thereof. For example, glycerin, triethylene glycol and Hystar TPF can be mixed together to form an aerosol forming material. Also, a propylene glycol/glycerin mixture is used.

Examples of other aerosol forming materials include volatile flavoring agents and tobacco flavor modifiers. Volatile flavoring agents include menthol, vanillin, cocoa, licorice, organic acids, high fructose corn syrup, and the like. Various other flavoring agents for smoking articles are set forth in Leffingwell et al., *Tobacco Flavoring For Smoking Products* (1972) and in European Patent Publication No. 407,792. Tobacco flavor modifiers include levulinic acid, metal (e.g., sodium, potassium, calcium and magnesium) salts of levulinic acid, and the like.

The preferred aerosol forming material, glycerin, has an affinity for moisture, particularly atmospheric moisture. On standing glycerin will absorb moisture, based upon the relative humidity present. For example, at a relative humidity of 40%, glycerin will absorb about 15% weight percent of water. This affinity for water can affect the delivery of the aerosol from cigarettes and other smoking articles.

Using the wicking substrates of the present invention and the water affinity of glycerin, smoking articles can be prepared which have a uniform aerosol delivery on each puff. This is accomplished by adding water to the glycerin as another aerosol forming material, based upon a 40% relative humidity factor, i.e., at about 15% by weight. By adding water during formation of the product, the glycerin looses most, if not all, of its affinity for additional water, and thus a consistent delivery can be achieved.

The amount of aerosol forming material which is employed per smoking article can vary and depends upon factors such as the components of the aerosol forming material and the composition of the particular substrate which carries the aerosol forming material. Generally, the amount of aerosol forming material employed per smoking article ranges form about 20 mg to about 200 mg, preferably about 35 mg to about 150 mg. When paper or paper-type substrates are employed, it is preferable that the weight of the aerosol forming material which is carried by that substrate be about 2 to about 4 times the dry weight of the substrate material.

In most embodiments of the present invention, the combination of the fuel element and the substrate (also known as the front end assembly) is attached to a mouthend piece; although a disposable fuel element/substrate combination can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges form 40 mm to about 85 mm.

Advantageously, the length of the mouthend piece is such that (i) the burning portion of the fuel element is kept well away from the fingers of the smoker; and (ii) hot vaporized aerosol forming materials have sufficient time to cool before reaching the mouth of the smoker. Oftentimes, it is highly desirable to provide a void space within the mouthend piece immediately behind the aerosol generating means. For example, a void space extending at least about 10 mm along the length of the smoking article may be provided immediately behind the aerosol generating means and forward of any tobacco cut filler, tobacco paper or filter segments.

A segment of gathered tobacco paper can be incorporated in the mouthend piece. Such a segment can be positioned directly behind the substrate or spaced apart therefrom. A segment of gathered carbon paper can be incorporated into the mouthend piece, particularly in order to introduce menthol flavor to the aerosol. Suitable gathered carbon paper segments are described in European Patent Publication No. 432,538. If desired, a segment including a gathered web of non-woven polypropylene or polyester in intimate contact with a water soluble tobacco extract can be incorporated into the mouthend piece. Such a segment is described in U.S. patent application Ser. Nos. 07/414,835, filed Nov. 29, 1989, and 621,499, filed Dec. 7, 1990.

Suitable mouthend pieces normally are inert with respect to the aerosol forming material, offer minimum aerosol loss as a result of condensation or filtration, and are capable of withstanding the temperatures experienced using use of the smoking article. Exemplary mouthend pieces include plasticized cellulose acetate tubes, such as is available as SCS-1 from American Filtrona Corp.; polyimide tubes available as Kapton from E. I. duPont de Nemours; paperboard or heavy paper tubes; and aluminum foil-lined paper tubes.

The tubular mouthend piece is positioned in an abutting end-to-end relationship with the front end assembly of the cigarette, i.e., the fuel element and substrate combination. Preferably, the cross-sectional shape and dimensions of the mouthend piece are essentially identical to those of the front end assembly. The front end assembly and the combination of the mouthend segments are attached to one another using a circumscribing tipping paper.

The extreme mouth end region of the smoking article preferably includes a filter element or tip, particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, gathered webs of non-woven polypropylene materials, or gathered webs of cellulose acetate or paper. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

The entire length of the smoking article, or any portion thereof, can be overwrapped with cigarette paper. Preferred papers which circumscribe the heat conducting member should not openly flame during use of the smoking article, should have controllable smolder properties, and should produce a gray ash. Exemplary, cigarette papers are described in U.S. Pat. No. 4,779,631 to Durocher et al. and European Patent Publication No. 304,766. Suitable paper wrappers are available as P-1981-152, P-1981-124 and P-1224-63 from Kimberly-Clark Corp. Tipping paper can circumscribe the extreme mouth end of the smoking article. Suitable tipping papers are non-porous tipping papers treated with "non-lipsticking" materials, and such papers will be apparent to the skilled artisan.

Smoking articles of the present invention incorporate some form of tobacco. The form of the tobacco can vary, and advantageously more than one form of tobacco is incorporated into a particular smoking article. For instance, tobacco can be incorporated into and/or around the fuel element. Similarly, tobacco can be incorporated into and/or around the aerosol generating means. Finally, tobacco can be positioned within the mouthend piece in a variety of fashions so that various flavorful tobacco components are transferred to the aerosol or its precursor hot gases. The type and form of tobacco employed in these various segments of the smoking article can vary, and includes flue-cured, Burley, Maryland and Oriental tobaccos, the rare and specialty tobaccos, as well as blends thereof.

One form of tobacco useful herein is tobacco cut filler (e.g., strands or shreds of tobacco filler having widths of about 1/15 inch to about 1/40 inch, and lengths of about ¼ inch to about 3 inches). Tobacco cut filler can be provided in the form of tobacco laminae, volume expanded or puffed tobacco laminae, processed tobacco stems including cut-rolled or cut-puffed stems, or reconstituted tobacco material. Processed tobaccos, such as those described in U.S. patent application Ser. Nos. 07/392,519, filed Aug. 10, 1989 and 07/484,587, filed Feb. 23, 1990, also can be employed. Reconstituted tobacco material can be provided using cast sheet techniques; papermaking techniques, such as described in U.S. Pat. Nos. 4,962,774 to Thomasson et al. and 4,987,906 to Young et al.; or extrusion techniques, such as are described in U.S. Pat. No. 4,821,749 to Toft et al.

Cut filler normally is incorporated into the cigarette as a cylindrical roll or charge of tobacco material which is wrapped in a circumscribing paper wrapper. Tobacco cut filler can be provided as a roll in a paper wrapper using cigarette rod making techniques and apparatus which are well known by the skilled artisan. Tobacco cut filler also can be incorporated in the aerosol generating means, if desired.

Another form of tobacco useful herein is tobacco paper. For example, a web of tobacco paper available as P-144-GNA from Kimberly-Clark Corp. can be gathered into a cylindrical segment in a manner set forth in Example 2 of U.S. Pat. No. 4,807,809 to Pryor et al. Cylindrical segments of gathered tobacco paper can be incorporated (i) into the aerosol generating means to act as a substrate for the aerosol forming material, and/or (ii) within the mouthend piece of the cigarette. If desired, tobacco paper can form an inner liner of the tubular mouthend piece of the smoking article.

Another form of tobacco useful herein is finely divided tobacco material. Such a form of tobacco includes tobacco dust and finely divided tobacco laminae. Typically, finely divided tobacco material is carried by the substrate which is positioned within the aerosol generating means. However, finely divided tobacco material also can be incorporated into the fuel element.

Another form of tobacco useful herein is tobacco extract. Tobacco extracts typically are provided by extracting a tobacco material using a solvent such as water, carbon dioxide, sulfur hexafluoride, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils, tobacco essences and other types of tobacco extracts. Methods for providing suitable tobacco extracts are set forth in U.S. Pat. Nos. 4,506,682 to Mueller, 4,986,286 to Roberts et al., and 5,005,593 to Fagg; European Patent Publication No. 338,831; and U.S. patent application Ser. Nos. 07/452,175, filed Dec. 18, 1989, 07/536,250, filed Jun. 11, 1990, 07/680,207, filed Apr. 4, 1991, 07/709,959, filed Jun. 4, 1991, 07/710,273, filed Jun. 4, 1991, and 07/717,457, filed Jun. 19, 1991.

Also useful are flavorful tobacco compositions such as those described in U.S. Pat. No. 5,016,654 to Bernasek et al. Another form of tobacco is enzymatically treated tobacco extract. This extract is described in U.S. patent application Ser. No. 07/721,860, filed Jun. 21, 1991.

The present invention will be further illustrated with reference to the following examples which aid in the understanding of the present invention, but which are not to be construed as limitations thereof. All parts and/or percentages reported herein, unless otherwise specified, are percent by weight. All temperatures are expressed in degrees Celsius.

EXAMPLE 1

Fuel Element Preparation

A symmetrical fuel element having the configuration substantially of that shown in FIG. 1A is prepared as follows:

A generally cylindrical longitudinally segmented fuel element 12 mm long and 4.8 mm in diameter, and having an apparent (bulk) density of about 1.02 g/cc is prepared from about 88 parts hardwood pulp carbon having an average particle size of 12 microns in diameter, and 12 parts Hercules 7HF SCMC binder.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is dry mixed with the sodium carboxymethyl cellulose binder, and then water is added to provide an extrudable mixture.

Cylindrical fuel rods (each about 24 inches long) are extruded using a screw extruder from the mixture having a generally cylindrical shape about 4.8 mm in diameter, with six (6) equally spaced peripheral grooves (about 1 mm×1 mm) with rounded bottoms, running from end to end. The extruded rods have an initial moisture level ranging from about 32–34%. They are dried at ambient temperature for about 16 hours and the final moisture content is about 7–8%.

The dried cylindrical rods are end trimmed to a length of 22.5 inches using diamond tipped steel cutting wheels. The rods are placed into a rotating drum having a plurality of channels adapted from accepting and retaining each fuel rod. The rods are secured into the channels on the drum by a plurality of thin rubber straps. The drum is rotated past a shaft having a series of spaced, thin, circular, diamond tipped steel blades. Exemplary blades are the 4-inch diameter 100 to 120 grit blades available from the Norton Co. as 1AIR. The blades are positioned on a shaft so as to create the isolation segments along the length of each rod and trim the rod to the correct length for the next operation. The dimensions of the isolation segments are provided by movement of the shaft or by the use of a wobble plate. The drum continues to rotate and the rod is released therefrom.

The cut rod is then placed into another rotating drum having a plurality of channels adapted for accepting and retaining the rod. The rods are secured in the channels on the drum by a plurality of thin rubber straps. The drum is rotated past a shaft having a series of spaced diamond tipped blades positioned to cut through the rod in the desired locations, forming individual fuel elements. The drum continues to rotate to release the cut fuel elements therefrom into a collection bin.

The finished fuel elements are each 12 mm in length, having end segment lengths of 2.5 mm, two isolation segments 1.5 mm in length each, and an intermediate segment 4.0 mm in length. As such, the cross-sectional area of the isolation segments is about 49% of the cross-sectional area of the end segments. Each fuel element weighs about 165 mg.

Front End Preparation

The fuel element is circumscribed by Owens-Corning C-glass fibers. For details regarding the properties of this material see pages 48–52 of the monograph entitled *Chemical and Biological Studies of New Cigarette Prototypes That Heat Instead of Burn Tobacco,* R. J. Reynolds Tobacco Co. (1988). The glass fibers are in turn circumscribed by a paper wrapper available from Kimberly-Clark Corp. as P-850-63-5, providing a cylinder having open ends for the passage of air therethrough, a length of about 16 mm and a circumference of about 7.5 mm.

Substrate Preparation

A rod of gathered filter paper available as MS2408/S538 from Filtrona, Ltd. is cut to a segment having a length of about 5 mm, and a length of about 3 mm and a diameter of about 3 mm is punched therefrom through the center of the segment. The segment has a dry weight of about 55 mg and about 125 mg glycerin and flavorants are added to the substrate.

Mouthend Piece

A paper tube of about 63 mm length and about 7.5 mm diameter is made from a web of paper about 27 mm wide. The paper is a 76 lb. Mouthpiece Paper having a thickness of about 0.012 inch, and is available from Simpson Paper Co. The paper is formed into a tube by lap-joining the paper using a water-based ethylene vinyl acetate adhesive. The inner surface of the tube is coated with Hercon 70 form Hercules, Inc. about 10 mm into the tube and allowed to dry. Then, the once coated inner surface of the tube is again coated, but with an aqueous solution of calcium chloride, and allowed to dry.

The substrate is inserted into the coated end of the paper tube such that the front face of the substrate is about 3 mm from the front end of the paper tube. The substrate is held in place securely within the paper tube by friction fit. A 10 mm long segment of tobacco cut filler, wrapped in a circumscribing paper wrapper is inserted into the opposite end of the tube. This tobacco segment is pushed into the tube so that the back end of the tobacco is about 10 mm from the extreme mouth end of the tube.

Into the end of the paper tube opposite the substrate is inserted a cylindrical filter element so as to abut the segment of tobacco cut filler. The filter element has a length of about 10 mm and a circumference of about 24 mm. The filter element is provided using known filter making techniques from cellulose acetate tow (8.0 denier per filament; 40,000 total denier) plasticized using triacetin, and circumscribing paper plug wrap.

Assembly of the Cigarette

The mouthend piece and front end are positioned in an abutting, end-to-end relationship, such that the front face of the substrate is positioned about 3 mm from the back face of the fuel element. The front end and mouthend pieces are held together by a circumscribing paper wrapper which acts as a tipping paper. The paper wrapper is a low porosity paper and available as P-850-61-2 from Kimberly-Clark Corp., and circumscribes the entire length of the front end piece except for about a 3 mm length of the front end piece at the extreme lighting end thereof.

The cigarette is smoked, and yields visible aerosol and tobacco flavor (i.e., volatilized tobacco components) on all puffs for about 10 puffs. The fuel element burns to about the region thereof where the burning portion meets the isolation portion, and the cigarette self-extinguishes.

EXAMPLE 2

Symmetrical cylindrical fuel elements having the following arrangement of longitudinally disposed segments:

are extruded with six equally spaced (1 mm×1 mm) peripherally extending grooves from the combustible mixture described in Example 1 and the isolation segments are formed by making "cut-outs" as described in Example 1. The final length of the fuel elements in this example is 12 mm long, and each of the longitudinally adjacent segments has the dimensions given below:

EXAMPLE 2A two end segments—2.5 mm long×4.8 mm diameter
two cut-out segments—each 2.5 mm long×2.4 mm in depth
one intermediate segment—2 mm long×4.8 mm diameter

EXAMPLE 2B two end segments—2.6 mm long×4.8 mm diameter
two cut-out segments—each 2.4 mm long×2.4 mm in depth
one intermediate segment—2 mm long×4.8 mm diameter

EXAMPLE 2C two end segments—2.5 mm long×4.8 mm diameter
four cut-out segments—each 1.5 mm long×1.2 mm in depth
one intermediate segment—4 mm long×4.8 mm diameter

EXAMPLE 2D two end segments—2.2 mm long×4.8 mm diameter
two cut-out segments—each 2.4 mm long×2.4 mm in depth
one intermediate segment—2.8 mm long×4.8 mm diameter

EXAMPLE 3

Extruded longitudinally segmented carbonaceous fuel elements containing sodium carbonate are prepared as follows:

The fuel elements are fabricated from a blend containing 90% by weight of Kraft hardwood carbonized pulp ground to an average particle size of 12 microns (as measured using a Microtrac) and 10% Kelco HV ammonium alginate binder. This blend of carbon powder and binder is mixed together with aqueous solutions of sodium carbonate of varying strength to form extrusion pastes or doughs from which the fuel elements were processed into their final form. The $Na_2CO_3$ solution strengths used in forming the fuel elements are: (a) 0.5%, (b) 1.0%, (c) 3.0%, (d) 5.0%, and (e) 7.0% sodium carbonate by weight in water. Approximately 30% by weight of each $Na_2CO_3$ solution is added to each blend to form the various doughs.

The hardwood pulp carbon is prepared as in Example 1 by carbonizing a non-talc containing grade of Grand Prairie Canadian Kraft hardwood paper under a nitrogen blanket.

The fuel dough or paste is extruded using a ram extruder, providing fuel rods having 6 equally spaced peripheral channels in the form of grooves, each having a depth of about 0.035 inch and a width of about 0.027 inch. The configuration of the slots which extend longitudinally along the periphery of the fuel element are substantially as shown in Figure 1A.

After extrusion, the wet fuel rods are dried to a moisture level of about 4.0%. The resulting dried rods are first cut to form the isolation segments and then finally cut into 12 mm lengths, thereby providing fuel elements.

EXAMPLE 4

Cigarettes having substantially the configuration of FIG. 1 are prepared from the following component parts as follows:

Fuel Element

A segmented fuel element containing tobacco in the combustible mixture, and having the configuration substantially as that shown in FIG. 1A is prepared as follows:

A generally cylindrical longitudinally segmented fuel element 12 mm long and 4.8 mm in diameter, is prepared from about 82 percent hardwood carbon, having an average particle size (Microtrac) of about 7 μm in diameter, about 10 percent ground tobacco (a milled "American Blend" of tobacco cut filler) the tobacco being approximately 200 Tyler mesh, and 8 parts Hercules 7XF SCMC binder.

The carbon is prepared as in Example 1 by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 7 microns in diameter.

The finely powdered hardwood carbon is admixed with the ground tobacco, the sodium carboxymethyl cellulose binder, and sufficient water to provide an extrudable mixture.

Fuel elements are extruded using a screw extruder to form cylindrical fuel rods about 18 inches long with six (6) equally spaced peripheral grooves (about 1 mm×1 mm). The fuel rods are cut with the diamond blade to make four equally spaced isolation segments (each 2.5 mm from the ends and 2.5 mm wide×1.9 mm deep) and then cut to a final length of 12 mm.

Substrate

The paper substrate for this cigarette is prepared by providing cellulosic paper web having a width of about 225 mm and a basis weight of about 22 g/m$^2$ (e.g., a paper available as 2-1079-C-01B from Kimberly-Clark). The web is formed into a rod circumscribed by a foil backed paper outer wrap using a rod making unit available as CU-10 or CU2OS from Decoufle s.a.r.b. together with a KDF-2 rod making apparatus from Hauni-Werke Korber & Co., KG.

The continuous web of substrate material is embossed; folded into a plurality of longitudinally extending folds the paper is gathered in such a manner so as to provide a rod having a generally compressed "S"-shape when viewed end on. The final substrate length is 10 mm, the weight is 70 mg, and the substrate is loaded with 175 mg of aerosol forming and flavor components, including 125 mg of glycerin, 30 mg of KDN and 20 mg of a 10% solution of a flavorant containing 2,3-pentanedione and tobacco.

Insulating/Retaining Jacket

The insulating and/or retaining jacket is a 16 mm long segment comprising four alternating layers of tobacco paper (2 each) and Owens Corning "C" glass (2 each), overwrapped with two paper layers, an inner paper wrapper, Kimberly-Clark No. P780-63-5, and an outer paper wrapper, Kimberly-Clark No. P1981-152, coating with 11% (pick-up) $Na_2SiO_3$, applied as a 15% solution of $Na_2SiO_3$.

Mouthend Piece

The mouthend piece is a 20 mm long tobacco segment consisting of reconstituted tobacco sheet containing 50% tobacco parts and 50% wood pulp. Adjacent the tobacco segment is a 20 mm long filter segment consisting of cellulose acetate tow (8.0 denier per filament & 15,000 total denier) treated to carry 6% triacetin. The mouthend tube is an 80 mm long paper tube lined with 0.001" thick aluminum foil for 40 mm. The mouthend piece is tipped with cork and has no air dilution perforations. The overall length of the cigarette is 87 mm and the weight is 1.317 g.

EXAMPLE 6

Paper substrates useful herein include the following:

EXAMPLE 6A

A 50 mg crimped and rolled segment of 14×40 mm KC paper No. P-1976-29-8, loaded with a 125 mg mixture of aerosol forming materials and flavorants consisting of:

| | |
|---|---|
| 82.44% | glycerin |
| 1.26% | levulinic acid |
| 4.94% | Burley tobacco extract (Meer Co.) |
| 0.38% | Maple flavor (Quest Inc.) |
| 9.90% | water (distilled) |
| 1.08% | ATE - the dried solids from an aqueous tobacco extract (of about 90 parts water and about 10 parts tobacco extract) provided by treating Burley tobacco strip with ammonia and steam, essentially as described in U.S. Pat. application Ser. No. 07/710,273, filed June 4, 1991. |
| 100.00% | |

EXAMPLE 6B

A 50 mg crimped and rolled segment of 14×40 mm KC paper No. P-1976-29-8, loaded with a 153 mg mixture of aerosol forming materials and flavorants consisting of:

(a) Dried solids (35 mg) derived from:

| | |
|---|---|
| 60.00% | American Blend tobacco enzyme extract, prepared as disclosed in Example 1 of U.S.S.N. 07/72/860 Attorney Docket No. AA-109-R & D, filed 6/21/91 |
| 30.00% | Maryland tobacco enzyme extract |
| 10.00% | Burley tobacco enzyme extract |

(b) Aerosol formers (118 mg) containing:

| | |
|---|---|
| 2.00% | ATE |
| 3.00% | levulinic acid |
| 95.00% | a mixture of 2 parts hydrolyzed starch (Hystar TPF - Lonza, Inc.) and 1 part triethylene glycol |

EXAMPLE 6C

A 50 mg crimped and rolled segment of 14×40 mm KC paper No. P-1976-29-8, loaded with a 129 mg mixture of aerosol forming materials and flavorants consisting of:

| | |
|---|---|
| 3 mg | 2% ATE |
| 6 mg | heat treated tobacco extract mixture provided as in Ex. 1 of U.S.S.N 07/717457, Attorney Docket No. AA-140-R & D, filed 6/19/91 |
| 120 mg | glycerin |

EXAMPLE 6D

A 50 mg crimped and rolled segment of 14×40 mm KC paper No. P-1976-29-8, loaded with a 115 mg mixture of aerosol forming materials and flavorants consisting of:

(a) Dried solids (15 mg) derived from:

| | |
|---|---|
| 50.00% | Flue Cured tobacco enzyme extract |
| 50.00% | Maryland tobacco enzyme extract |

(b) Aerosol formers consisting of:

| | |
|---|---|
| 95.00% | glycerin |
| 3.00% | levulinic acid |
| 2.00% | ATE |

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A fuel element for smoking articles, the fuel element having a longitudinal axis, and comprising two end segments longitudinally displaced along the axis, each end segment having substantially the same cross-sectional area; at least one intermediate segment disposed longitudinally between the end segments having a cross-sectional area substantially the same as the end segments; and at least two reduced cross-sectional area isolation segments disposed longitudinally between the end segments and the intermediate segments, the fuel element further comprising more than one intermediate segment, each of which is separated by an isolation segment having a cross-sectional area less than that of any one of the isolation segments.

2. The fuel element of claim 1, wherein the isolation segments are on the same longitudinal plane of the fuel element.

3. The fuel element of claim 1, wherein the isolation segments are on opposite sides of a plane through the longitudinal axis of the fuel element.

4. The fuel element of claim 3, wherein the carbonaceous materials comprise at least 75 percent of the combustible composition of the fuel element.

5. The fuel element of claim 1, which comprises a combustible composition selected from carbonaceous material and tobacco materials and a binder.

6. The fuel element of claim 5, wherein the carbonaceous materials comprise at least 75 percent of the combustible composition of the fuel element.

7. A front-end assembly for smoking articles comprising a fuel element having two end segments having substantially the same cross-sectional area, at least one intermediate segment having a cross-sectional area the same as the end segments; and at least two reduced cross-sectional area isolation segments disposed between the end segments and the intermediate segment(s), the fuel element being circumscribed by a jacket of resilient fibers, wherein the jacket extends beyond the end segments of the fuel element, recessing the fuel element within the jacket.

8. The front-end assembly of claim 7, wherein the fuel element is recessed within the jacket at each end by up to about 3 mm.

9. The front-end assembly of claim 7, wherein the resilient fibers of the circumscribing jacket comprise glass fibers.

10. The front-end assembly of claim 7, wherein the resilient fibers of the circumscribing jacket comprise alternating layers of glass fibers and tobacco materials.

11. The front-end assembly of claim 7, wherein the two end segments of the fuel element have substantially the same size, in length and width.

12. The front-end assembly of claim 7, wherein the two end segments of the fuel element have substantially the same cross- sectional shape.

13. The front-end assembly of claim 7, wherein the two isolation segments of the fuel element have substantially the same size, in length and width.

14. The front-end assembly of claim 7, wherein the two isolation segments of the fuel element have substantially the same cross-sectional shape.

15. The front-end assembly of claim 7, wherein the two isolation segments of the fuel element are spaced substantially the same distance from the respective ends of the fuel element.

16. A smoking article comprising:

(a) a combustible fuel element comprising two end segments having substantially the same cross-sectional area, at least one intermediate segment having a cross-sectional area the same as the end segments; and at least two reduced cross-sectional area isolation segments disposed between the end segments and the intermediate segment(s), and (b) an aerosol generating means longitudinally disposed behind the fuel element and physically spaced apart therefrom.

17. The smoking article of claim 16, wherein the two isolation segments of the fuel element are substantially the same in shape and size.

18. The smoking article of claim 16 or 17, wherein the two isolation segments of the fuel element are spaced substantially the same distance from each end of the fuel element.

19. The smoking article of claim 16 or 17, further comprising a circumscribing insulating jacket of resilient fibers, surrounding the periphery of the fuel element and extending beyond the ends thereof, recessing the fuel element within the insulating jacket.

20. The smoking article of claim 19, wherein the insulating jacket comprises fibers which shrink upon heating.

21. The smoking article of claim 20, wherein the fibers of the insulating jacket comprise glass fibers.

22. The smoking article of claim 19, wherein the resilient fibers of the circumscribing jacket comprise alternating layers of glass fibers and tobacco materials.

23. A cigarette comprising:

(a) a combustible fuel element having two end segments having substantially the same cross-sectional area, at least one intermediate segment having the same cross-sectional area as the end segments; and at least two isolation segments having a cross-sectional area less than that of the end segments, wherein the isolation segments are positioned between each of the end segments and the intermediate segment(s);

(b) an aerosol generating means longitudinally disposed behind the fuel element and physically spaced apart therefrom; and (c) a mouthend piece.

24. The cigarette of claim 23, wherein the two isolation segments of the fuel element are substantially the same in shape and size.

25. The cigarette of claim 23 or 24, further comprising a circumscribing insulating jacket of resilient fibers, surrounding the periphery of the fuel element and extending beyond the ends thereof, recessing the fuel element within the insulating jacket.

26. The cigarette of claim 25, wherein the insulating jacket comprises fibers which shrink upon heating.

27. The cigarette of claim 26, wherein the fibers of the insulating jacket comprise glass fibers.

28. The cigarette of claim 25, wherein the resilient fibers of the circumscribing jacket comprise alternating layers of glass fibers and tobacco materials.

29. A cigarette comprising:

(a) a symmetrical combustible fuel element having two substantially identical end segments, two isolation segments having a cross-sectional area less than that of the end segments, said isolation segments respectively being positioned longitudinally adjacent one end segment; and a heat sinking segment having a cross-sectional area substantially the same as the end segments, positioned between the segments of reduced cross-sectional area;

(b) an aerosol generating means longitudinally disposed behind the fuel element and physically spaced apart therefrom; and (c) a mouthend piece.

30. The cigarette of claim 29, wherein the isolation segments are substantially the same in shape, size and distance from the end segments of the fuel element.

31. The cigarette of claim 29, wherein the cross-sectional area of the end segments and the cross-sectional area of the heat sinking segment are substantially the same.

32. The cigarette of claim 29, 30 or 31, which further comprises a jacket of resilient fiber material circumscribing the periphery of the fuel element and extending beyond the ends thereof, recessing the fuel element within the jacket.

33. The cigarette of claim 29, 30, or 31, wherein the aerosol generating means further includes a substrate for carrying the aerosol forming material.

34. The cigarette of claim 33, wherein the substrate is a cellulosic material.

35. The cigarette of claim 34, wherein the cellulosic substrate material is paper.

36. The cigarette of claim 34, wherein the cellulosic substrate material is tobacco paper.

37. The cigarette of claim 32, wherein the insulating jacket means comprises fibers which shrink upon exposure to heat from the burning fuel element.

38. The cigarette of claim 23 or 24, wherein the two isolation segments of the fuel element are spaced substantially the same distance from each end of the fuel element.

* * * * *